United States Patent [19]

Nestor et al.

[11] Patent Number: 4,586,775

[45] Date of Patent: May 6, 1986

[54] DUPLEX INSULATION DISPLACEMENT TERMINAL

[75] Inventors: Charles R. Nestor, Niles; Robert G. Plyler, Vienna, both of Ohio

[73] Assignee: General Motors Corporation, Detroit, Mich.

[21] Appl. No.: 637,291

[22] Filed: Aug. 3, 1984

[51] Int. Cl.[4] ..... H01R 4/24

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 4,174,877 | 11/1979 | Foederer | 339/97 P |
| 4,195,194 | 3/1980 | Kuster et al. | 339/97 R |
| 4,274,696 | 6/1981 | Long et al. | 339/97 R |

*Primary Examiner*—Joseph H. McGlynn

*Attorney, Agent, or Firm*—F. J. Fodale

[57] ABSTRACT

A duplex insulation displacement terminal comprises first and second terminal members connected side-by-side in a laterally spaced relationship by an integral bus strip. Each terminal member has a pair of spaced, longitudinally slotted plates which are connected by a side wall. The side wall of each terminal member has an elongated window near its slotted end.

2 Claims, 3 Drawing Figures

DUPLEX INSULATION DISPLACEMENT TERMINAL

This invention relates generally to sheet metal insulation displacement terminals having a pair of spaced, slotted plates for receiving an insulated electrical conductor and, more particularly, to a duplex arrangement of sheet metal insulation displacement terminals of this type in which a pair of insulation displacement terminal members are integrally connected side-by-side for receiving a pair of insulated electrical conductors. Such a duplex terminal may be used, for example, to terminate the ends of the wound electrical conductors which form the primary and secondary coils of a high energy ignition coil for an automobile.

It is already known that sheet metal insulation displacement terminals of the general type shown in U.S. Pat. No. 4,159,158 granted to Charles H. Weidler on June 26, 1979 can be duplexed by providing an integral bus strip connecting the corresponding slotted plates of a pair of terminal members arranged side-by-side. This known duplex terminal, however, has drawbacks.

One drawback is that a great deal of scrap is produced during manufacture because each terminal member comprises essentially an elongated strip of sheet metal which is reversely folded about its midpoint to provide a pair of spaced, slotted plates which are connected by strap members at one end of the terminal member. Consequently, the terminal member blanks are very long and the stamping of these very long terminal member blanks in side-by-side pairs for the duplex terminals results in a very long piece of offal or scrap from the lateral spacing of the terminal member blanks.

Another drawback of the known duplex terminal is that the tab receptacles are at the end of the plate members remote from the connecting strap members and, consequently, the tab receptacles are susceptible to opening up and diminishing the contact force on the tab. The receptacles also do locate the tabs laterally which is a desirable feature.

The object of this invention is to provide an improved duplex sheet metal insulation displacement terminal of the type in which the terminal members have a pair of spaced, slotted plates for piercing the insulation of an electrical conductor and forcefully contacting its conductive core.

A feature of the invention is that the pair of spaced, slotted plates of each terminal member is connected by a side wall so that slotted plates of each terminal member are laterally arranged rather than longitudinally arranged in the stamped blank. This reduces the length of the stamped terminal member blank and, consequently, the scrap resulting from stamping the terminal member blanks in laterally spaced pairs.

Another feature of the invention is that the terminal members are generally channel-shaped so as to provide strong tab receptacles which locate the tabs in the lateral direction.

Another feature of the invention is that the terminal members and bus strip are configured for equalizing the stresses in the arms of each slotted plate resulting from the biased engagement of the conductor cores.

Yet another feature of the invention is the provision of balanced retention barbs for each terminal member.

Other objects and features of the invention will become apparent to those skilled in the art as the disclosure is made in the following detailed description of a preferred embodiment of the invention as illustrated in the accompanying sheets of drawing in which.

Figure 1:
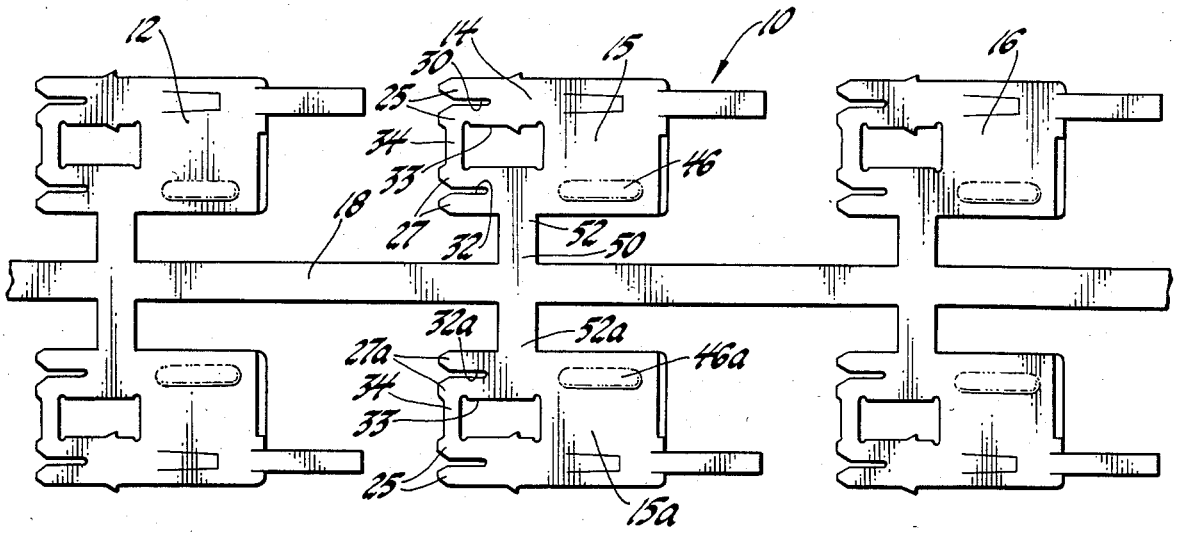
FIG. 1 is a plan view of a stamped sheet metal strip which may be used for making duplex terminals in accordance with this invention.

Referring now to the drawing, FIG. 1 shows a stamped strip 10 of sheet metal comprising identical stamped sheet metal blanks 12, 14 and 16 which are connected by a central carrier strip 18. The strip 10 is used to progressively die form duplex terminals 20 from each of the blanks, such as the duplex terminals 20 shown in solid lines in FIG. 2.

The typical blank 14 comprises blank portions 15 and **15*a* on opposite sides of the central carrier strip 18. The blank portions 15 and 15*a*** are mirror images of each other and generally rectangular in shape.

Figure 2:
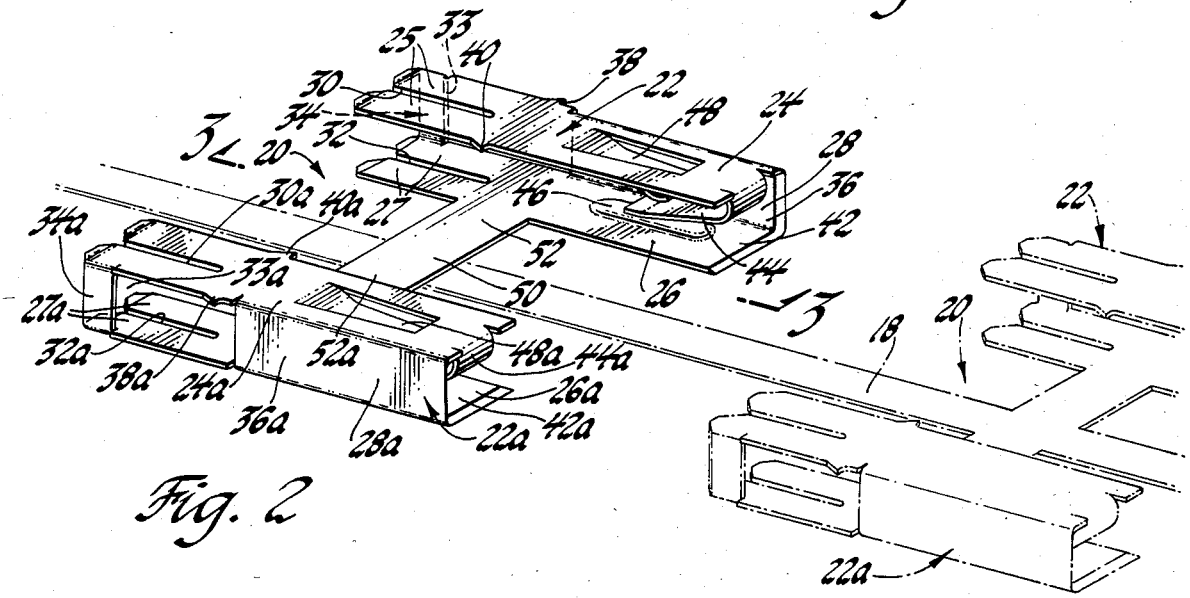
FIG. 2 is a perspective view of a duplex terminal in accordance with this invention.
Figure 3:
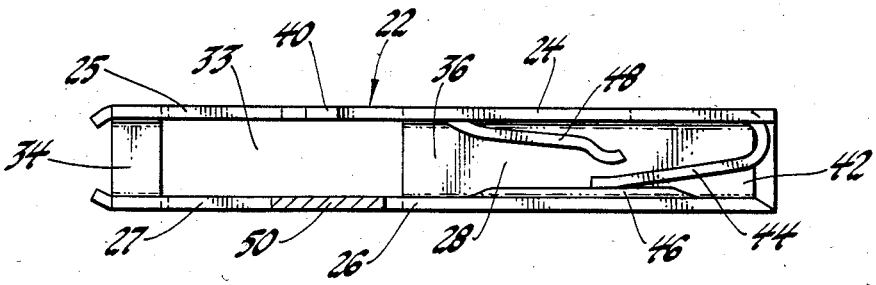
FIG. 3 is a section taken substantially along the line 3—3 of FIG. 2.

These blank portions 15 and **15*a* form the respective terminal members 22 and 22*a* of the duplex terminal 20** shown in FIGS. 2 and 3.

The terminal member 22 is generally channel-shaped and comprises a pair of elongated plates 24 and 26 connected at their respective outer longitudinal edges by a side wall 28. The plates 24,26 have narrow, longitudinal slots 30,32 at one end for receiving an insulated electric conductor (not shown). The longitudinal slots 30,32 are centrally located defining arms 25,27 of substantially the same width in the end of the plates 24,26. The tips of the arms 25,27 are trapezoidal and form enlarged flared openings for guiding an insulated electric conductor into the narrow inner portions of the slots 30,32, respectively. The inner portions of the slots 30,32 are sized to pierce the insulation and forcefully contact the conductive core of the conductor in a well known manner. The trapezoidal tips of the arms 25,27 are inclined slightly toward each other (as best shown in FIG. 3) to facilitate insertion of the terminal member 22 into a connector body cavity (not shown).

The side wall 28 has an elongated window 33 which separates the side wall into a narrow band portion 34 at the slotted end of the terminal member 22 and an elongated portion 36 at the opposite receptacle end. The narrow band portion 34 spaces the slotted end portions of the plates 24,26 without appreciably effecting the operation of the arms 25 which define the longitudinal slot 30 or the arms 27 which define the longitudinal slot 32. On the other hand, the window 33 is the full height of the side wall 28 and extends rearwardly of the arms 25,27 and the inner ends of the longitudinal slots 30,32 a considerable distance so that the elongated wall portion 36 likewise does not appreciably effect the operation of arms 25 and 27. Consequently, the arms 25 and the arms 27 tend to spread equally and receive equal stress when an insulated electrical conductor is forced into the longitudinal slots 30,32 of the plates 24,26.

The elongated window 33 also permits the formation of a barb 38 at the outer edge of the solid portion of the plate 24 rearwardly of the arms 25 and inner end of the slot 30. Barb 38 together with an opposite barb 40 at the inner edge of the plate 24 provides a balanced retaining means for securing the terminal member 22 in a connector body (not shown).

The plates 24,26 and the elongated side wall portion 36 form a channel-shaped tab receptacle 42 at the opposite end of the terminal member 22 which is relatively rigid and not prone to open up. The tab receptacle 42 includes a resilient tongue 44 which is attached to the end of the plate 24 and bent back into the receptacle 42 where it is biased against an elongated flat dimple 46 in the end of plate 26. The end of plate 24 also has a cut-out cantilevered support arm 48 which extends into the receptacle 42 to engage the end of the resilient tongue 44 and thereby increase the contact force on a tab inserted between the resilient tongue 44 and the dimple 46. The elongated side wall portion 36 also laterally locates a tab inserted into the receptacle 42.

The terminal member 22*a* is a mirror image of the terminal member 22 and its corresponding elements are identifed alphanumerically by an identifier consisting of the identical numeral for the element in terminal 22 and the letter "a".

The terminal members 22 and 22*a* are connected side-by-side in a laterally spaced relationship by an integral bus strip 50 to form the duplex terminal 20. The bus strip 50 comprises end portions 52,52*a* attached to the respective inner longitudinal edges of the plates 26,26*a* which are opposite to the respective outer longitudinal edges to which the side walls 28,28*a* are respectively attached. The middle portion of the bus strip 50 is part of the carrier strip 18 as is evident from FIG. 2.

The bus strip 50 is foreshortened in the longitudinal direction and attached to the solid portions of the plates 26,26*a* rearwardly of the arms 27,27*a* and inner ends of the longitudinal slots 32,32*a* as best seen in FIG. 1 so that the bus strip 50 does not appreciably effect the operation of the arms 27,27*a* of the plates 26,26*a* when insulated electric conductors are forced into the longitudinal slots 32,32*a*. Consequently, the stress equalization of the arms 27,27*a* provided by the shape of the individual terminal members 22,22*a* is maintained by the shape and location of the bus strip 50.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A duplex sheet metal insulation displacement terminal comprising, a first terminal member having a pair of spaced, elongated first plates which have longitudinal slots at one end and which are connected by a first side wall attached at respective longitudinal edges of the first plates, said first side wall having an elongated window separating the first side wall into a narrow band portion at the slotted end of the first terminal member and an elongated portion which commences rearwardly of the inner ends of the longitudinal slots to form a first channel-shaped receptacle at the opposite end, a second terminal member having a pair of spaced, elongated second plates which are longitudinally slotted at one end and connected by a second side wall attached at respective longitudinal edges of the second plates to form a second channel-shaped receptacle at the opposite end, said second wall having an elongated window separating the second side wall into a narrow band portion at the slotted end of the first terminal member and an elongated portion which commences rearwardly of the inner ends of the longitudinal slots to form a second channel-shaped receptacle at the opposite end, and an integral lateral bus strip connecting the first and second terminal members side-by-side in a laterally spaced relationship, said integral bus strip being attached at a longitudinal edge of a first plate which is opposite the first side wall and at a longitudinal edge of a second plate which is opposite the second side wall, said integral bus strip being foreshortened in the longitudinal direction and commencing rearwardly of the inner ends of the longitudinal slots in the first and second plates to which the integral bus strip is attached.

2. A duplex sheet metal insulation displacement terminal comprising, a first terminal member having a pair of spaced, elongated first plates which have longitudinal slots at one end and which are connected by a first side wall attached at respective longitudinal edges of the first plates, said first side wall having an elongated window separating the first side wall into a narrow band portion at the slotted end of the first terminal member and an elongated portion which commences rearwardly of the inner ends of the longitudinal slots to form a first channel-shaped receptacle at the opposite end, a second terminal member having a pair of spaced, elongated second plates which are longitudinally slotted at one end and connected by a second side wall attached at respective longitudinal edges of the second plates to form a second channel-shaped receptacle at the opposite end, said second wall having an elongated window separating the first side wall into a narrow band portion at the slotted end of the first terminal member and an elongated portion which commences rearwardly of the inner ends of the longitudinal slots to form a first channel-shaped receptacle at the opposite end, an integral lateral bus strip connecting the first and second terminal members side-by-side in a laterally spaced relationship, said integral bus strip being attached at a longitudinal edge of one first plate which is opposite the first side wall and at a longitudinal edge of one second plate which is opposite the second side wall, said integral bus strip being foreshortened in the longitudinal direction and commencing rearwardly of the inner ends of the longitudinal slots in the first and second plates to which the integral bus strip is attached, and said other first plate and said other said plate each having a pair of barbs projecting from opposite longitudinal edges for securing the first and second terminal members in connector body cavities.

* * * * *